US012146725B2

(12) United States Patent
Olsen

(10) Patent No.: US 12,146,725 B2
(45) Date of Patent: Nov. 19, 2024

(54) LOCKING SYSTEMS AND METHODS FOR HANDGUARD OF A FIREARM

(71) Applicant: Killer Innovations, Inc., Tumwater, WA (US)

(72) Inventor: Richard Brady Olsen, Rainier, WA (US)

(73) Assignee: Killer Innovations, Inc., Tumwater, WA (US)

( * ) Notice: Subject to any disclaimer, the term of this patent is extended or adjusted under 35 U.S.C. 154(b) by 0 days.

(21) Appl. No.: 18/296,035

(22) Filed: Apr. 5, 2023

(65) Prior Publication Data

US 2023/0324140 A1 Oct. 12, 2023

Related U.S. Application Data

(60) Provisional application No. 63/328,207, filed on Apr. 6, 2022.

(51) Int. Cl.
*F41C 23/16* (2006.01)
*F41A 3/66* (2006.01)

(52) U.S. Cl.
CPC ..... *F41C 23/16* (2013.01); *F41A 3/66* (2013.01)

(58) Field of Classification Search
CPC ..... F41C 23/16
USPC ..... 42/71.01, 72
See application file for complete search history.

(56) References Cited

U.S. PATENT DOCUMENTS 8,562,243 B2 10/2013 Dizdarevic
8,739,448 B2 6/2014 Kimmel
8,806,793 B2 8/2014 Daniel
8,863,426 B1 10/2014 Zinsner
8,904,691 B1 12/2014 Kincel
9,157,697 B2 10/2015 Leclair
9,389,043 B1 7/2016 Zhang
9,464,865 B2 10/2016 Shea
9,476,672 B2 10/2016 Wells
9,476,673 B2 10/2016 Miller
9,528,793 B1 12/2016 Oglesby
9,557,137 B2 1/2017 Dzwill
9,599,430 B1 3/2017 Geissele
10,018,445 B2 7/2018 Fesas
10,066,897 B2 9/2018 Hwang
10,126,095 B1 11/2018 Reid
10,145,648 B1 12/2018 Holder
(Continued)

FOREIGN PATENT DOCUMENTS

WO WO-2013010515 A1 * 1/2013 ..... F41C 23/16

OTHER PUBLICATIONS

Non-Final Office Action mailed Sep. 25, 2024 in related U.S. Appl. No. 18/048,623.

*Primary Examiner* — Reginald S Tillman, Jr.

(74) *Attorney, Agent, or Firm* — Eversheds Sutherland (US) LLP

(57) ABSTRACT

A handguard is for a firearm having a firearm upper. The handguard includes a body and a cam. The body is structured to be coupled to the firearm upper. The body has a central lumen having a longitudinal axis. The cam may be coupled to the body in substantially perpendicular alignment to the longitudinal axis, and is configured to rotate between an UNLOCKED position and a LOCKED position. When the cam rotates from the UNLOCKED position toward the LOCKED position, the cam rotates into the central lumen.

18 Claims, 9 Drawing Sheets

(56) References Cited

U.S. PATENT DOCUMENTS

| | | | | |
|---|---|---|---|---|
| 10,240,892 | B2 | 3/2019 | Leitner-Wise | |
| 10,309,747 | B2 | 6/2019 | Samson | |
| 10,352,650 | B2 | 7/2019 | Hiler, Jr. | |
| 10,436,549 | B1 | 10/2019 | Taylor | |
| 10,591,247 | B2 | 3/2020 | Hubbell | |
| 10,619,971 | B2 | 4/2020 | Hubbell | |
| 10,670,369 | B1 | 6/2020 | Ding | |
| 10,775,129 | B1 | 9/2020 | Kincel | |
| 10,809,038 | B2 | 10/2020 | Geissele | |
| 10,935,343 | B2 | 3/2021 | Chin | |
| 11,248,874 | B2 | 2/2022 | Kincel | |
| 11,326,853 | B2 | 5/2022 | Zinsner | |
| 11,365,953 | B2 | 6/2022 | Kincel | |
| 11,371,802 | B2 | 6/2022 | Liao | |
| 11,892,260 | B2 * | 2/2024 | Markut | F41A 21/481 |
| 2011/0126443 | A1 | 6/2011 | Sirois | |
| 2014/0373419 | A1 | 12/2014 | Leclair | |
| 2017/0023329 | A1 | 1/2017 | Gottzmann | |
| 2018/0202757 | A1 | 7/2018 | Samson | |
| 2022/0018629 | A1 | 1/2022 | Senff | |
| 2022/0128331 | A1 | 4/2022 | Kincel | |
| 2022/0252374 | A1 | 8/2022 | Louthan | |
| 2022/0260335 | A1 | 8/2022 | Williams | |
| 2022/0282951 | A1 | 9/2022 | Wiggins | |
| 2022/0404119 | A1 | 12/2022 | Zinsner | |
| 2023/0129047 | A1 | 4/2023 | Miller | |
| 2024/0003654 | A1 | 1/2024 | Boomgaarden | |

* cited by examiner

LOCKING SYSTEMS AND METHODS FOR HANDGUARD OF A FIREARM

CROSS-REFERENCE TO RELATED APPLICATION

This application claims priority to and claims the benefit of U.S. Provisional Patent Application Ser. No. 63/328,207, filed Apr. 6, 2022, the entire contents of which are hereby incorporated by reference herein.

TECHNICAL FIELD

The present application relates generally to locking systems and methods for handguards, and also to firearms, including the same.

BACKGROUND

Handguards for firearms are known. Handguards commonly include elongated bodies and barrel nuts that are configured to be coupled to a firearm. A known drawback with respect to handguards is the strength and ease with which handguards are secured to a barrel nut attached to a firearm. It is with respect to these and other considerations that the instant disclosure is concerned.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

The apparatuses disclosed herein are concerned with securing barrel nuts to bodies of handguards. The handguard may be for a firearm having a firearm upper, and may include a handguard body and a cam locking system. The handguard body may be coupled to the firearm upper, and have a central lumen having an axis. The cam locking system may be coupled to the handguard body in substantially perpendicular alignment to the axis and be configured to rotate between an UNLOCKED position and a LOCKED position. When a cam of the cam locking system rotates from the UNLOCKED position toward the LOCKED position, the cam rotates into the lumen. It is in this manner that a barrel nut is configured to be reliably secured in the body of the handguard.

More specifically, during assembly of the handguard, any number of the cams may be in the UNLOCKED position. In this position, substantially flat surfaces of the cams may face the lumen of the body of the handguard in order to allow the barrel nut to be inserted and removed. When the cams are in this position, the flat surfaces may be substantially flush with (e.g., has the same contour as) an interior surface of the body of the handguard. Additionally, once the barrel nut is inserted, the cams are configured to rotate to the LOCKED position such that in this position, round or radial surfaces of the cams press up against radial flutes of the barrel nut. Furthermore, in this LOCKED position, the round or radial surfaces of the cams extend into the lumen of the body of the handguard, and the substantially flat surfaces face away from the lumen.

In one example, the cams rotate between 110 and 130 degrees when rotating between the UNLOCKED position to the LOCKED position. It will thus be appreciated that when the cams are rotated to the LOCKED position, they press the barrel nut up into a sidewall of the interior of the body of the handguard and engage in radial flutes in the barrel nut, thereby securing the barrel nut within the handguard. Additionally, when the barrel nut needs to be removed, the cams may be rotated back to the UNLOCKED position, thereby allowing the barrel nut to be pulled out of the body of the handguard with relative ease. The cams may be rotated between the LOCKED and UNLOCKED positions with a screwdriver (e.g., a hex screwdriver) or other suitable tools, which can extend into the cams to turn them.

Furthermore, in one example, a firearm includes an upper, a barrel attached to the upper, and the aforementioned handguard with a barrel nut for securing the barrel to the upper and for securing the handguard body to the upper.

These and other advantages of the present disclosure are provided in greater detail herein.

ILLUSTRATIVE EMBODIMENTS

As employed herein, the term "number" shall mean one or an integer greater than one (i.e., a plurality).

As employed herein, the term "coupled" shall mean connected together either directly, or via one or more intermediate parts or components.

Figure 1:
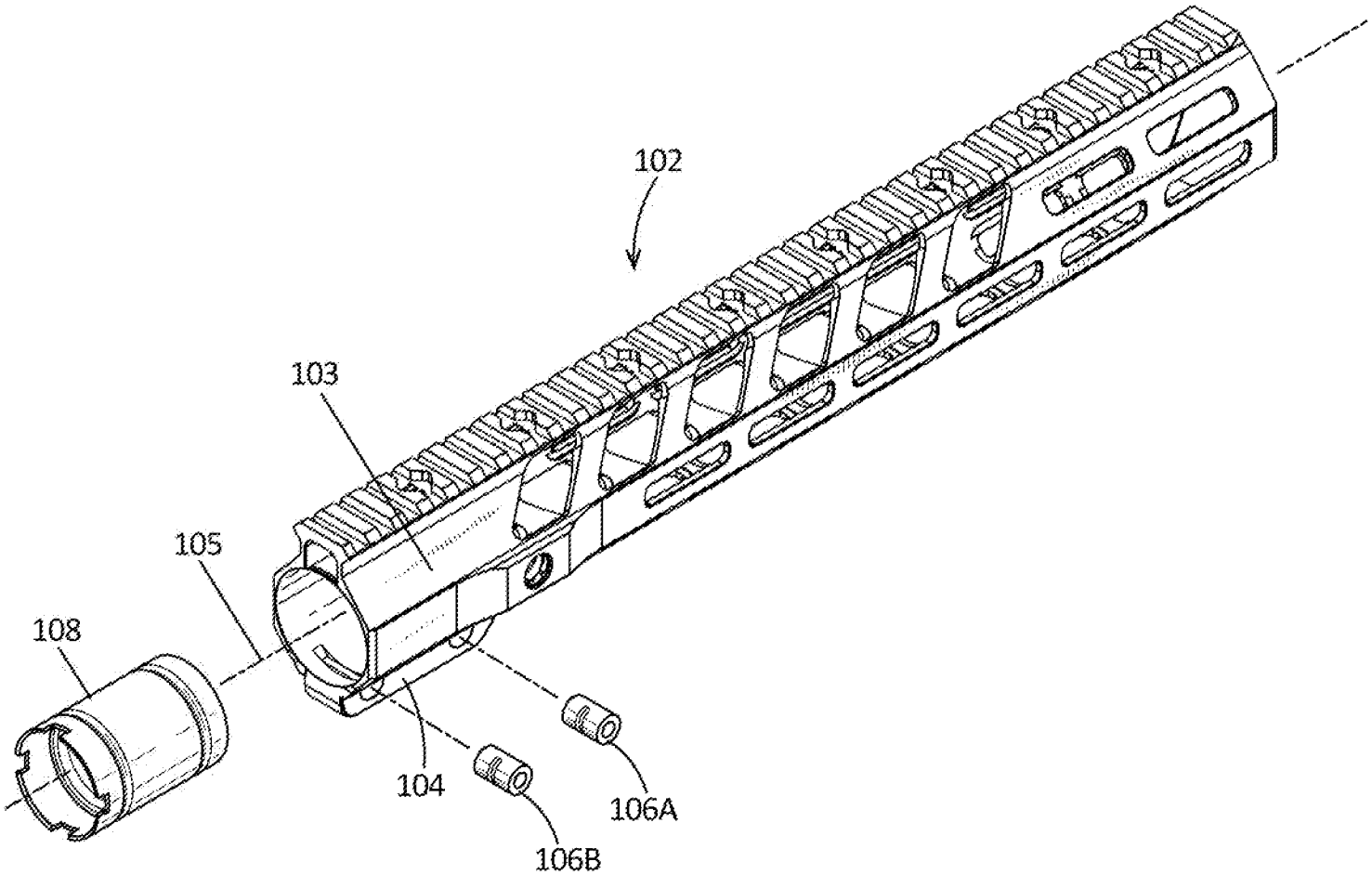
FIG. 1 is a perspective view of a handguard with a cam locking system according to one or more examples of the disclosure.
Figure 3A:
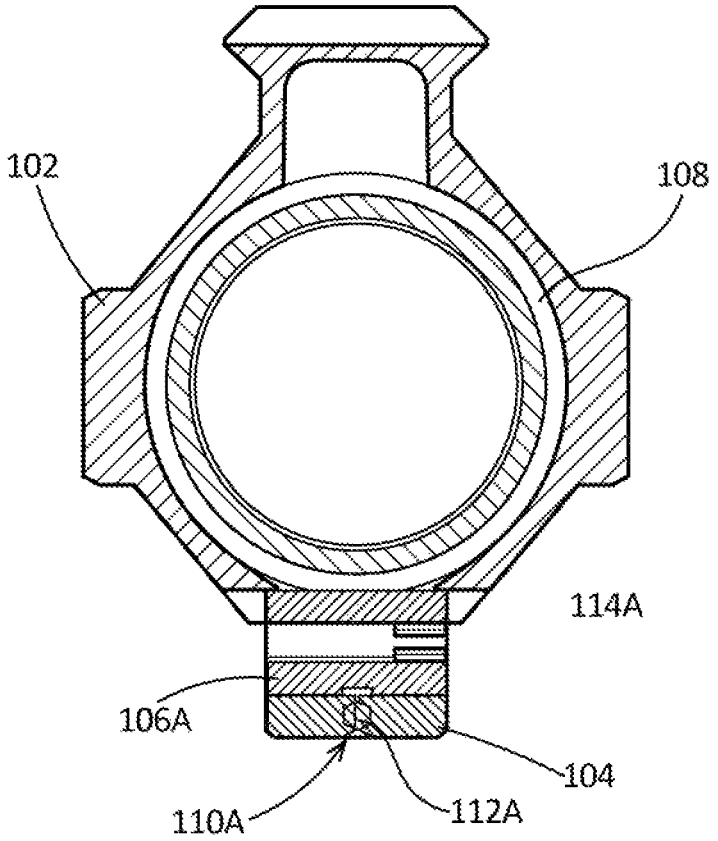
FIG. 3A is a cross-section view of the handguard of FIG. 2A with the cam locking system, according to one or more examples of the disclosure.
Figure 3B:
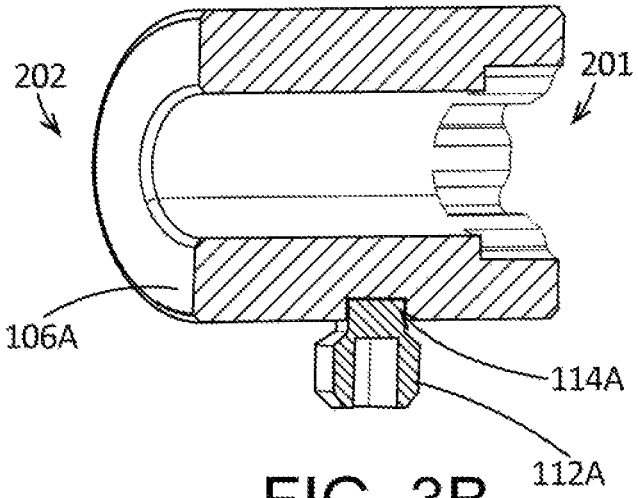
FIG. 3B is a cross-section view of a cam and a coupling member, according to one or more examples of the disclosure.
Figure 4:
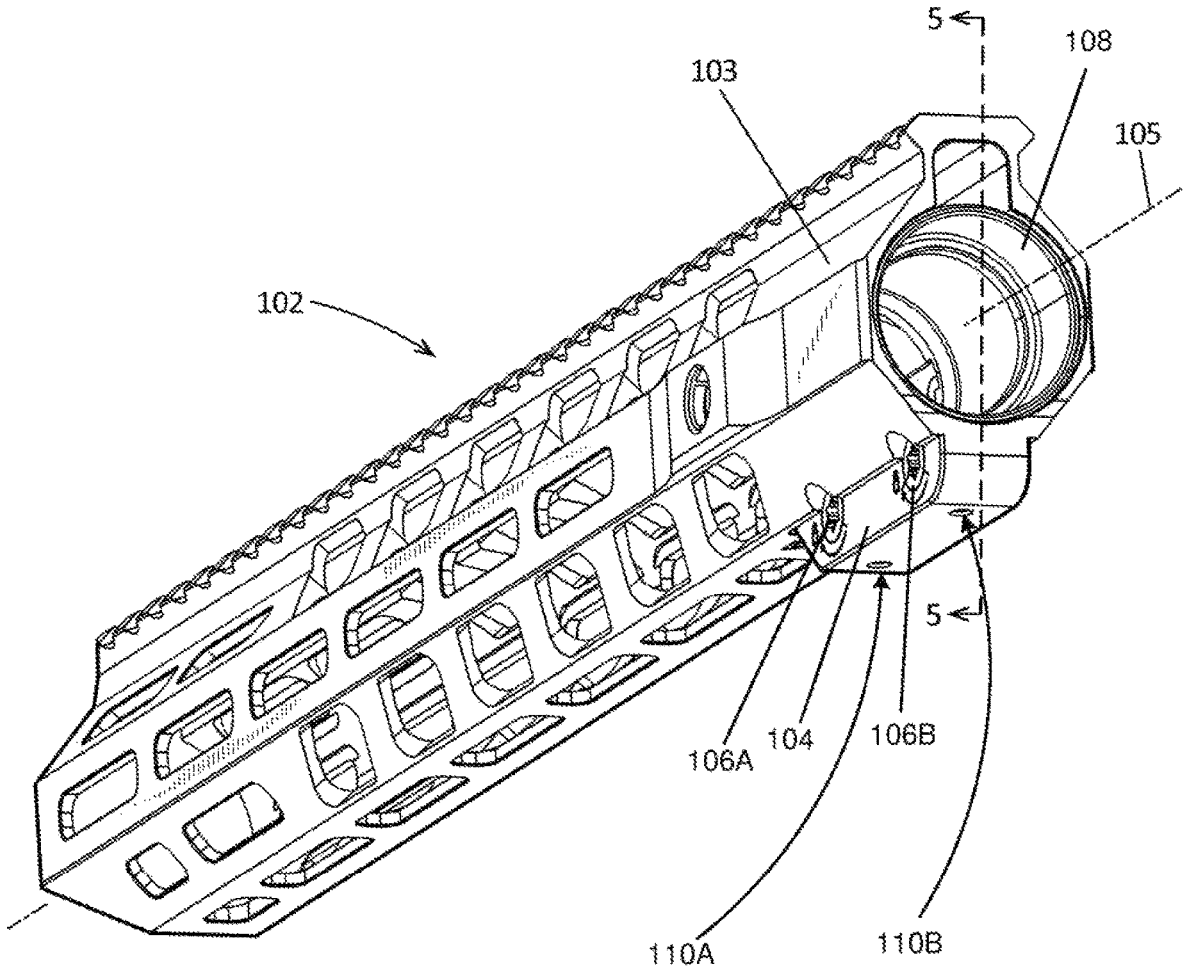
FIG. 4 is another perspective view of the handguard with the cam locking system, according to one or more examples of the disclosure.

The present disclosure provides for a handguard 102, as shown in FIGS. 1 and 4, that may be used with a firearm. In one example, the firearm may include a firearm upper, a barrel attached to the firearm upper, and the handguard 102. The handguard 102 may include an elongated body 103 that is structured to be coupled to the firearm upper, a number of cams 106A,106B, a barrel nut 108, and at least one coupling member (e.g., locking screws 112A,112B in, for example, FIGS. 3A, 3B). The cams 106A,106B, which may be part of a cam locking system, are inserted within a protrusion 104 of the body 103 of the handguard 102. The barrel nut 108 may be used, in addition to securing the body 103, for securing the barrel of the firearm to the firearm upper.

Figure 2A:
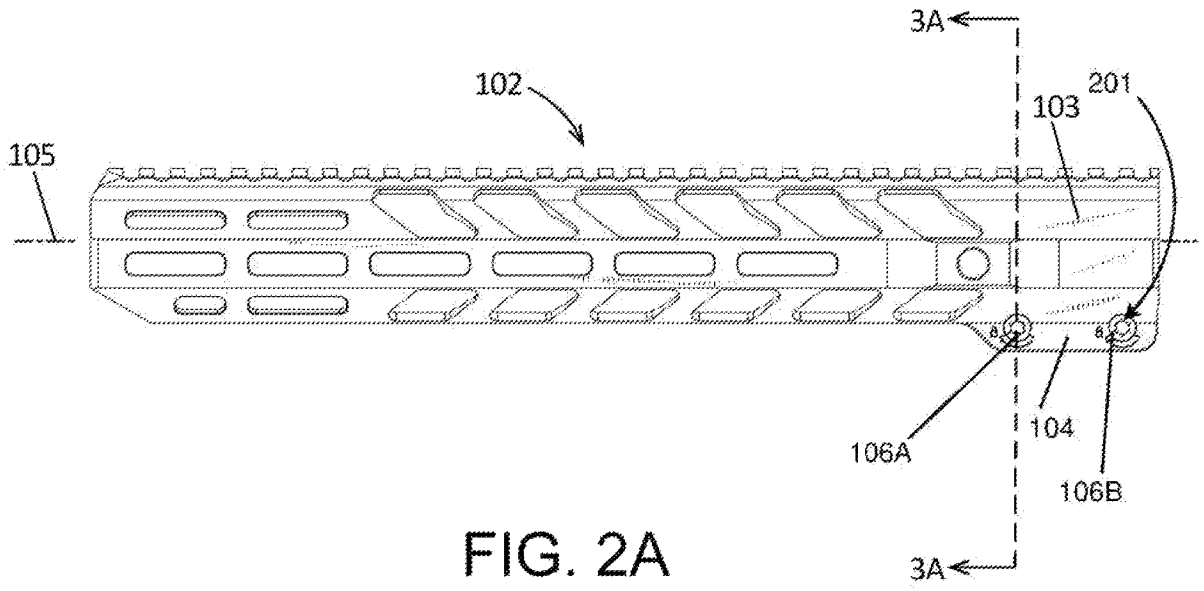
FIGS. 2A and 2B are side views of the handguard according to claim 1.
Figure 2B:
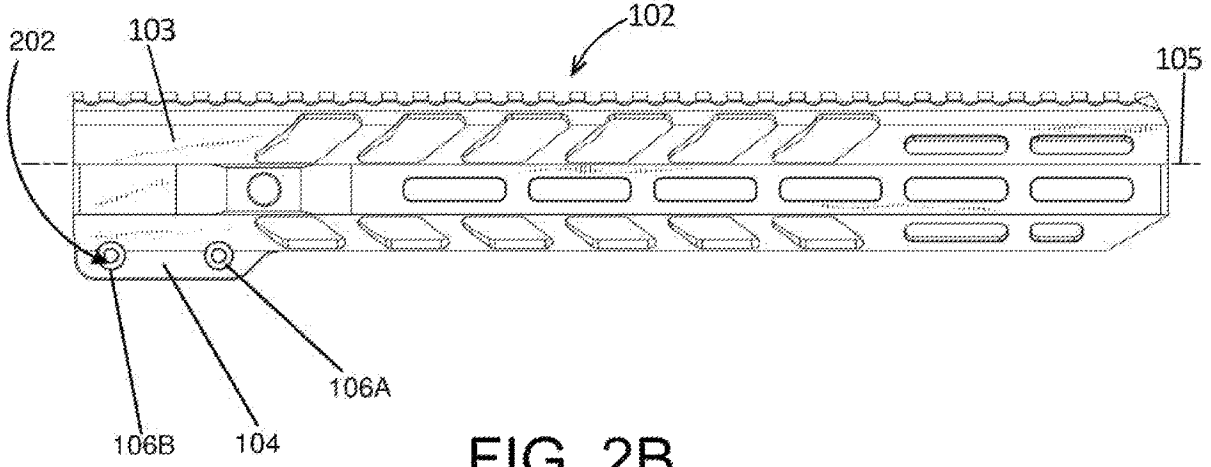

The body 103 of the handguard 102 can be securely attached to the barrel nut 108 by the first cam 106A and the second cam 106B, which are inserted through the protrusion 104 of the handguard 102. The protrusion 104 may be on the bottom of the handguard 102 but can also be on any other side of the handguard 102. As shown in FIG. 2A and FIG. 2B, in some embodiments, the first cam 106A and the second cam 106B are each visible from both sides of the body 103 side. The cams 106A,106B may each have a first side 201 and second side 202. The second side 202 may be configured to receive a screwdriver, or other tools, to turn the cam 106. In other embodiments the first side 201 or both the second side 202 and first side 201 may be configured to receive a screwdriver or other tool to turn the cam. As will be discussed in greater detail below, when the cam 106 is rotated, the cams 106 respectively engage radial flutes (e.g., radial flutes 122 in FIGS. 6A-6D) in the barrel nut, thereby forcing the barrel nut 108 against the body 103 of the handguard 102 to secure the barrel nut 108 within the handguard 102 in a press fit manner. One or more embodiments of the handguard 102 with barrel nut locking mechanisms are disclosed in the FIGS.

As shown in FIG. 1, in some embodiments, the handguard 102 can be any shape or configuration as desired for operating as a handguard 102. The body 103 of the handguard 102 may have a central lumen having a longitudinal axis 105, and the cams 106A,106B may be in substantially perpendicular alignment to the longitudinal axis 105. Additionally, the cams 106A,106B may be configured to be maintained on the protrusion 104 of the body 103 via the locking screws 112A,112B. For example, and without limitation, as shown in the side views of FIGS. 2A-2B and the cross-sectional views of FIGS. 3A-3B taken along '3A-'3A of FIG. 2A, and also FIG. 7B, the cams 106A,106B each preferably have a channel 114A,114B, and the locking screws 112A,112B are configured to extend into the channel 114A,114B in order to maintain or lock the cams 106A,106B in the body 103. That is, as the cams 106A,106B are rotated, the locking screws 112A,112B slide within the respective channels 114A,114B. In one example, the locking screws 112A,112B are coupled to the body 103 (e.g., directly threadably coupled to the body 103) and accessible via apertures 110A and 110B (see, e.g., FIG. 4). Furthermore, the locking screws 112A,112B may each having corresponding longitudinal axes that are substantially perpendicular to the longitudinal axis 105 of the lumen.

Figure 5A:
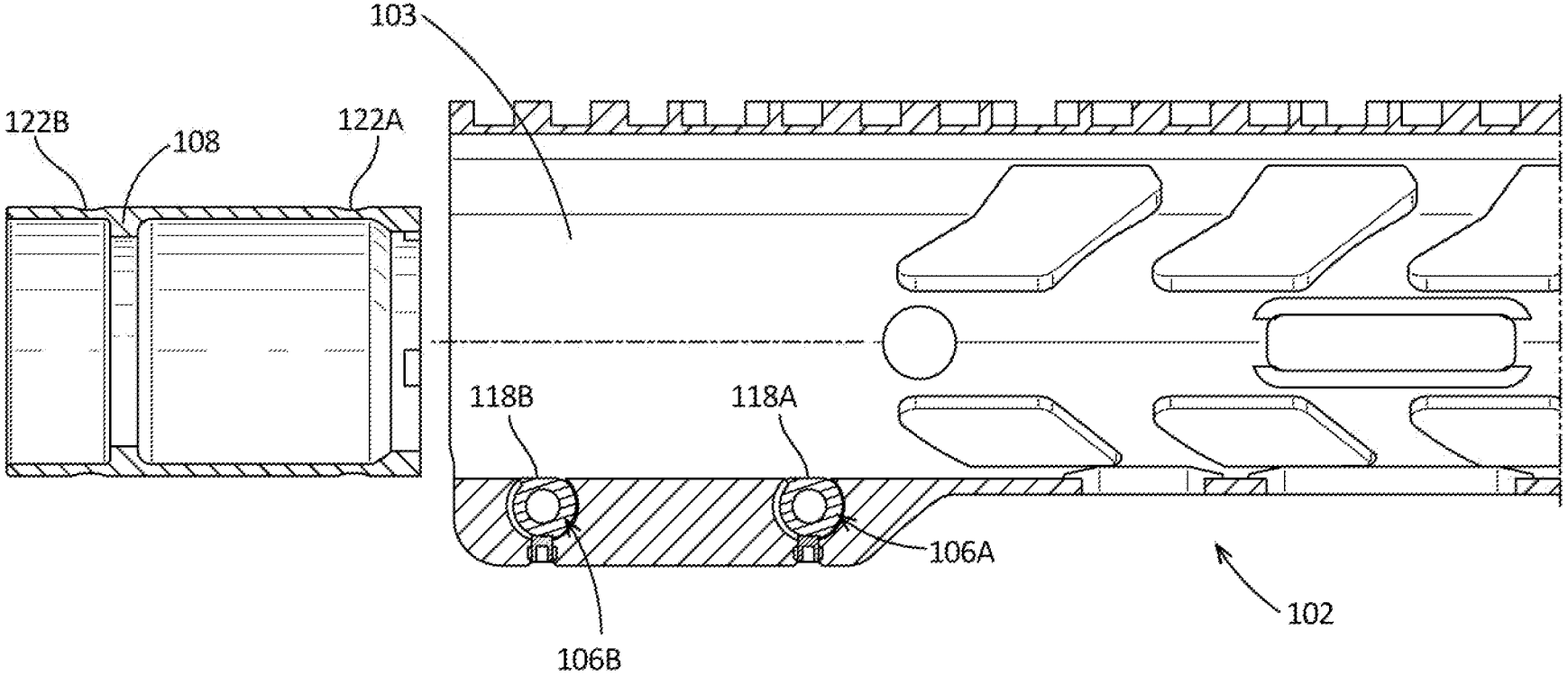
FIG. 5A is an exploded section view of a portion of the handguard of FIG. 4, shown with the barrel nut exploded and with the cams in an UNLOCKED position, according to one or more examples of the disclosure.
Figure 5B:
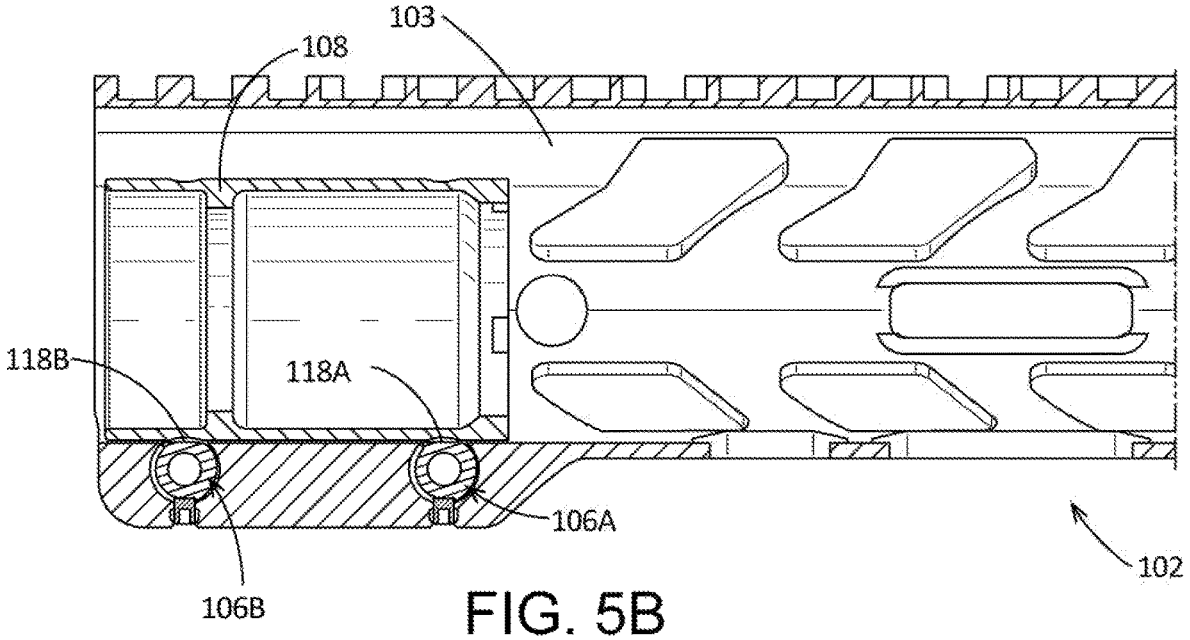
FIG. 5B is a section view of the handguard of FIG. 5A, shown with the barrel nut inserted into the body of the handguard, and with the cams in the UNLOCKED position, according to one or more examples of the disclosure.
Figure 5C:
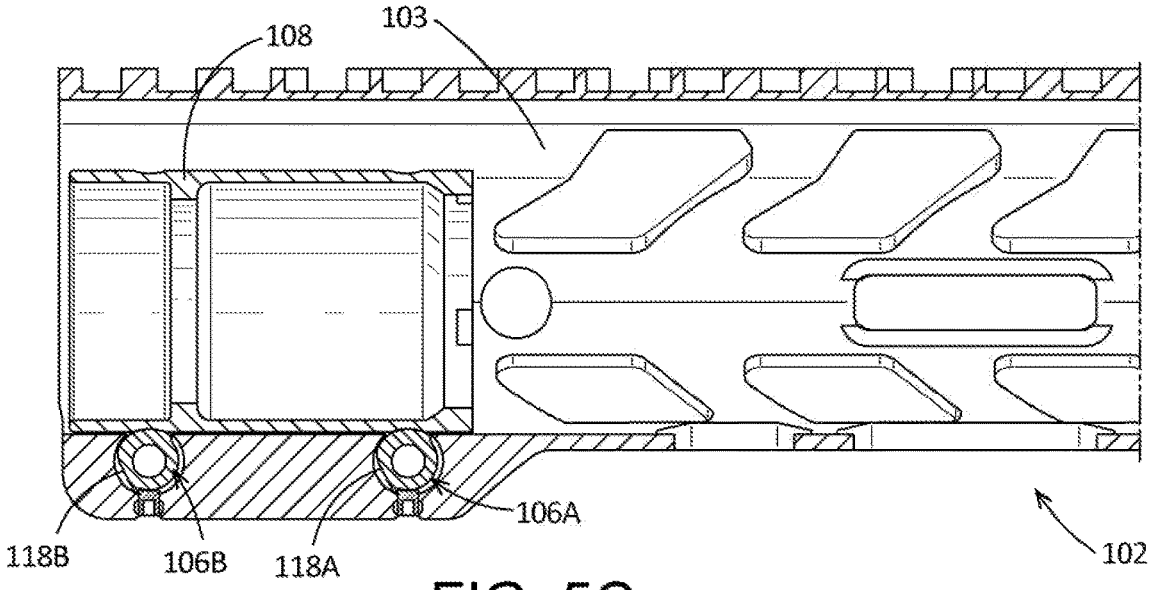
FIG. 5C is a section view of the handguard of FIG. 5B, shown with the cams rotated to a LOCKED position, according to one or more examples of the disclosure.
Figure 6A:
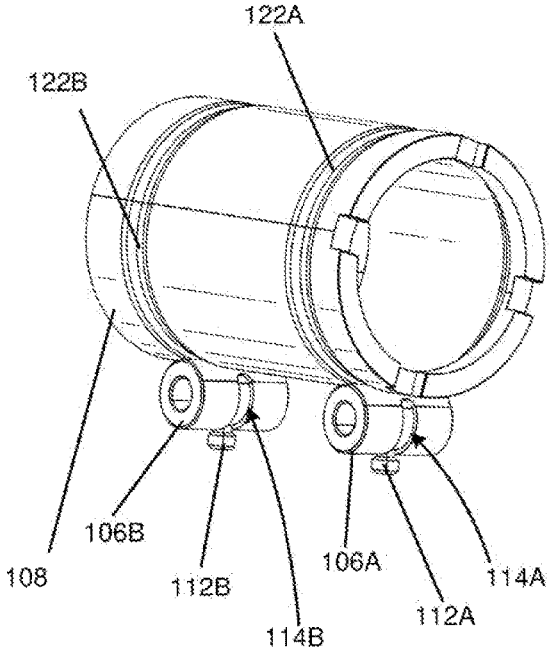
FIGS. 6A-6D are different views of a barrel nut with cams and coupling members, according to one or more examples of the disclosure.
Figure 6B:
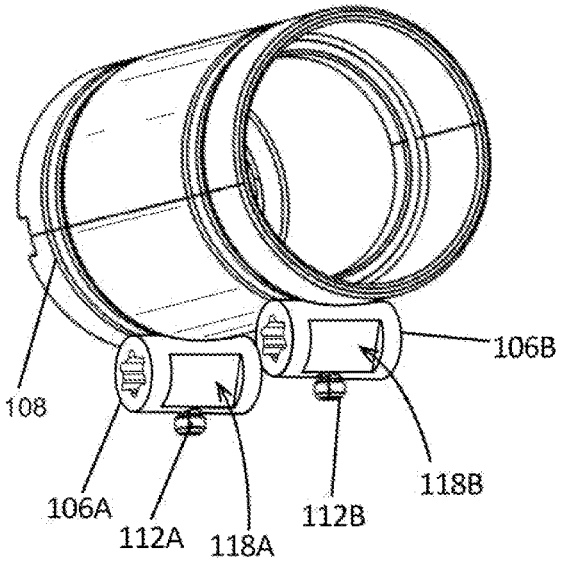
Figure 6C:
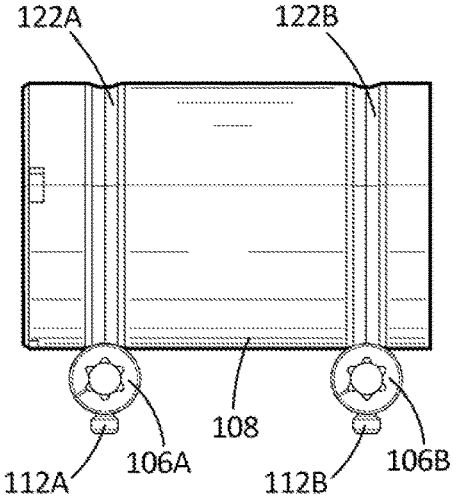
Figure 6D:
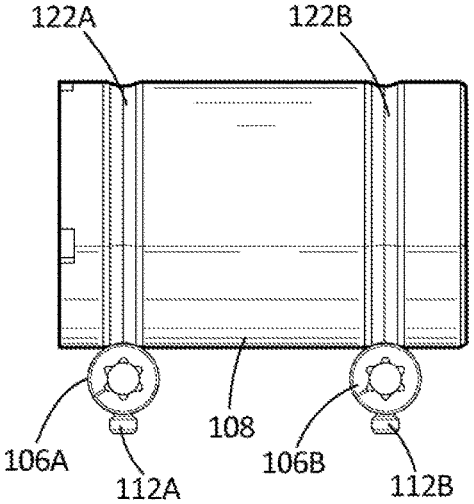

FIG. 4 is a perspective view of the handguard 102 with the cam locking system, according to one or more examples of the disclosure, and FIGS. 5A-5C are different cross-sectional views of the handguard 102, taken along '5-'5 in FIG. 4. FIG. 5A shows the barrel nut 108 of the handguard 102 exploded from the body 103 of the handguard 102. FIG. 5B shows the barrel nut 108 inserted into the lumen of the body 103 of the handguard 102, wherein the cams 106A and 106B are in an unlocked position allowing the insertion of the barrel nut 108 into the lumen of the body 103. FIG. 5C shows the barrel nut 108 inserted into the lumen of the body 103 of the handguard 102, and the cams 106A and 106B rotated from the unlocked position in FIG. 5B to a locked position, wherein a portion of the cams 106A and 106B enter into the lumen of the body and engage the radial flutes 122A and 122B of the barrel nut 108, thereby locking the barrel nut 108 locked therein, that is, to the body 103. The locking functionality of the cams 106A,106B, e.g., the manner in which they lock the barrel nut 108 to the body 103 of the handguard 102, will be further described below.

Figure 7A:
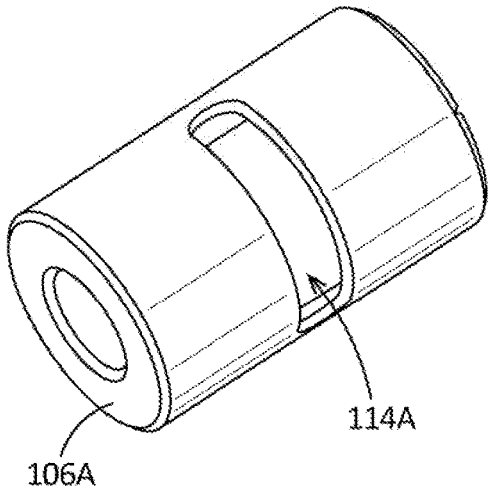
FIG. 7A is an isometric view of a cam.
Figure 7B:
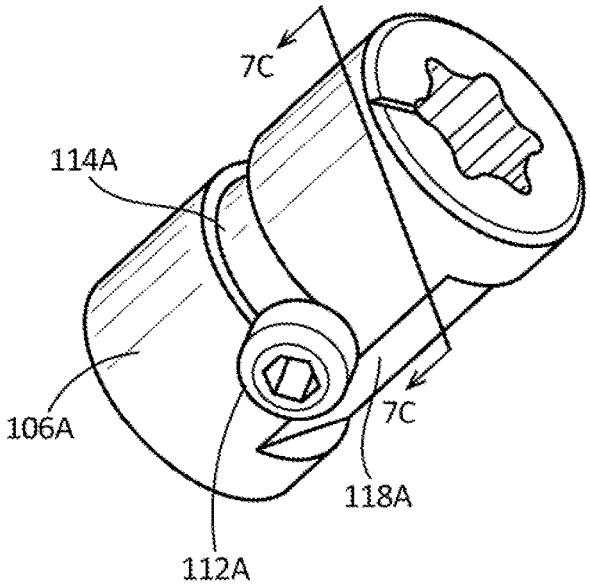
FIG. 7B is an isometric view of two cams.

FIGS. 6A-6D show views of the barrel nut 108, the cams 106A,106B, and the screws 112A,112B. As shown, the barrel nut 108 may have a pair of radial flutes 122A,122B, and the cams 106A,106B may press up into and engage the radial flutes 122A,122B when actuated into a locked position. That is, the cams 106A, 106B may index into the flutes 122A, 122B when rotated into a LOCKED position (FIG. 5C) to prevent any ability of the body 103 of the handguard 102 to slide laterally relative to the barrel nut 108. FIG. 7A shows an isometric view of the cam 106A, and FIG. 7B shows an isometric view of the cams 106A,106B coupled to the locking screws 112A,112B. As shown in FIG. 7B, the cams 106A,106B have the corresponding channels 114A, 114B into which the screws 112A,112B are configured to extend, and also have corresponding recess surfaces 118A, 118B, respectively. The recess surfaces 118A,118B may be flat or curved, but have a smaller radius R1 than the radius R2 of the cams 106A,106B. The recess surfaces 118A,118B may allow the barrel nut 108 to be flush with the interior surface of the body 103 (e.g., have the same contour as), or not extend into the lumen of the body 103 of the handguard 102 when inserted and in the unlock position, as will be discussed below.

Figure 7C:
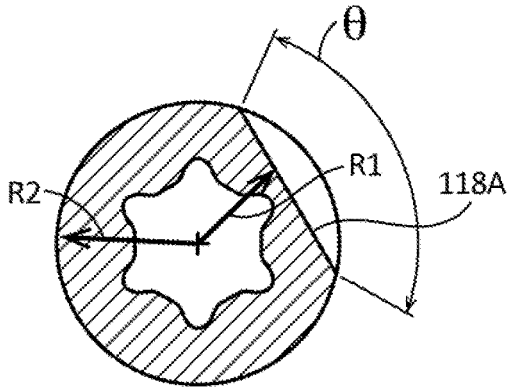
FIG. 7C is a section view of the cam of FIG. 7B, all according to one or more examples of the disclosure.

Additionally, as shown in FIG. 7B, the cams 106A,106B have hexagonal-shaped openings in at least one end that are configured to receive a screwdriver or other tool in order to cause them to be rotated within the body 103. It will, however, be appreciated that other suitable shapes besides a hexagonal-shaped opening are contemplated herein. FIG. 7C shows a cross-sectional view along lines '7C-'7C of FIG. 7B, wherein the radius R1 of the recess surface 118A is shown relative to the radius R2 of the cam 106A. The radial length θ of the recess surface may be 110-130 degrees in the illustrative embodiment. As will be appreciated, the recessed surfaces 118A and 118B may be planar as shown in FIG. 7C, or curved, essentially tracking the radius of the cam but with a smaller radius for a certain length θ.

Figure 8:
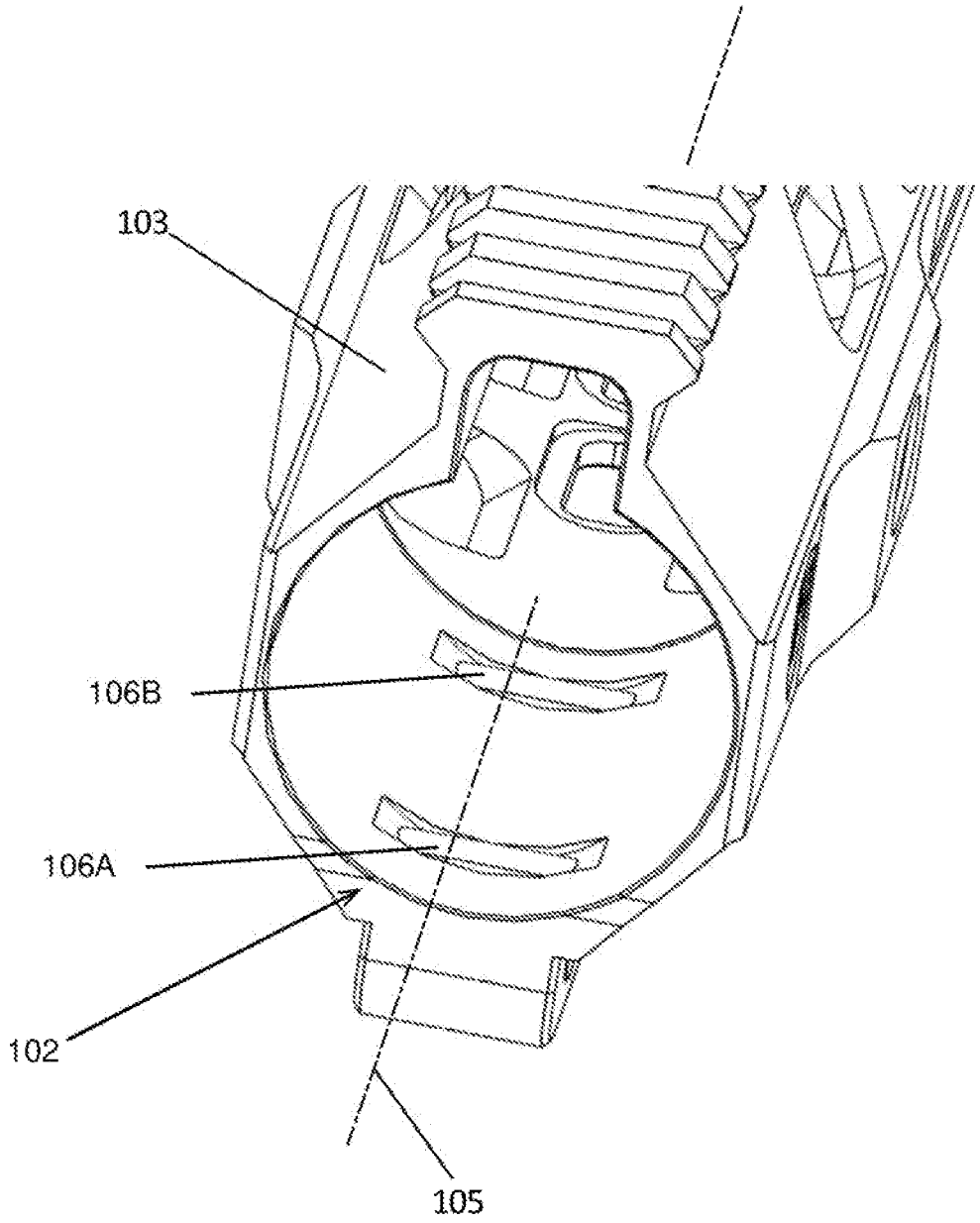
FIG. 8 is an isometric view of a handguard without the barrel nut according to one or more examples of the disclosure.

FIG. 8 shows another isometric view of a portion of the handguard 102, showing an interior of the lumen of the body 103. As shown, the cams 106A,108 extend at least partially into the lumen through apertures of the body 103, when in a locked position. That is, the cams 106A,106B protrude into the lumen of the body 103 such that they extend across a predetermined radius of the wall of the body 103.

Referring again to FIGS. 5A-5C, the functionality of the disclosed cam locking system will now be discussed. In one example, it will be appreciated that the barrel nut 108 is configured to be inserted into the lumen of the body 103 of the handguard 102. See FIG. 5A, for example, which shows the barrel nut 108 exploded from the body 103 of the handguard. Additionally, as shown in FIG. 5A, the recessed surfaces 118A,118B of the cams 106A,106B are facing the central lumen of the body 103 (e.g., when the recessed surfaces are substantially flat, they are substantially parallel to the axis 105 (FIG. 1) of the body 103). That is, these surfaces 118A,118B may be flush with bottom surfaces of the interior of the body 103, or recessed within apertures 802 of body 103, when in the position depicted in FIG. 5A. It will thus be appreciated that the surfaces 118A,118B are configured not to obstruct the barrel nut 108 so that it may be inserted into the body 103.

FIG. 5B shows the barrel nut 108 after having been inserted into the lumen of the body 103. As shown, when the barrel nut 108 is inserted into the lumen in the position depicted in FIG. 5B, the recessed surfaces 118A,118B of the cams 106A,106B still face the interior of the lumen of the body 103. This position (e.g., FIG. 5B) may be considered to be an UNLOCKED position of the cams 106A,106B. Accordingly, it will be appreciated that the cams 106A,106B are configured to rotate from the UNLOCKED position (e.g., FIG. 5B) to a LOCKED position (e.g., FIG. 5C).

When the cams 106A,106B rotate from the UNLOCKED position toward the LOCKED position, the cams 106A, 106B rotate into the central lumen of the body 103, and the recessed surfaces 118A,118B rotate such that in the LOCKED position, they face away from the central lumen of the body 103. See FIG. 5C, for example, which shows the cams 106A,106B having rotated into the central lumen of the body 103. In this LOCKED position (FIG. 5C), the cams 106A,106B press up against and have rotated into engagement with the corresponding radial flutes 122A,122B (FIG. 6A) in a press fit manner in order to secure the barrel nut 108 within the body 103.

Accordingly, as the cams 106A,106B are rotated, the recessed surfaces 118A, 118B rotate counter-clockwise (e.g., moving from FIG. 5B to FIG. 5C) away from the lumen of the body 103 of the handguard 102, and the circular portion of the cams 106A,106B pushes the barrel nut 108 up to be secured within the body 103. Additionally, as the cams 106A,106B rotate from the UNLOCKED position (FIG. 5B) to the LOCKED position (FIG. 5C), the cams do not move laterally within the body 103 of the handguard 102 due to the fixed position of the screws 112A,112B with respect to the body 103, and the manner in which the screws 112A,112B press into and slide within the channels 114A,114B. That is, the screws 112A,112B travel along the channels 114A,114B during this rotation of the cam 106A, 106B and keep the cams 106A,106B aligned while at the same time causing the barrel nut 108 to be pressed up into the body 103 of the handguard 102.

The disclosed handguard 102 is thus advantageous as compared to prior art handguards (not shown), in which barrel nuts may not be as firmly secured within lumens of bodies of handguards, may take more time for installation, and may loosen over time. That is, forces on the cams are perpendicular to the length of the cam, and there is no force urging the rotation of the cams from a LOCKED position to an UNLOCKED position, which is often the case where screws are used to tighten the handguard body about the barrel nut.

Additionally, when the cams 106A,106B rotate from the UNLOCKED position (FIG. 5B) to the LOCKED position (FIG. 5C), the cams 106A,106B preferably rotate between 110 degrees and 130 degrees, which range of motion may be limited by the size of the channels in the cams in which the screws 112A,112B are received. Thus, the screws 112A, 112B may limit rotation of the cams 106A,106B with respect to the body 103. See FIG. 5C, for example, which shows the screws 112A,112B engaging the end of channels 114A,114B so that the cams 106A,106B are not able to rotate any further in a counter-clockwise direction. This engagement may advantageously be considered as a stop for a user to know that he or she has moved the cams 106A,106B a correct predetermined amount and to thus indicate that the barrel nut 108 is secure within the body 103.

Although the disclosed concept has been described herein in association with the handguard 102, including the two cams 106A,106B, it will be appreciated that a suitable alternative handguard (not shown) may have any suitable alternative number of cams (e.g., one, three, four, etc.), in order to perform the desired function of securing the barrel nut 108 within the body 103 of the handguard 102. Furthermore, it will be appreciated that each of the cams 106A, 106B are configured the same as each other (e.g., configured to rotate between UNLOCKED and LOCKED positions in order to secure the barrel nut 108 within the body 103).

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A handguard for a firearm having a firearm upper, the handguard comprising:

a body structured to be coupled to the firearm upper, the body having a central lumen having a longitudinal axis; and a cam coupled to the body in substantially perpendicular alignment to the longitudinal axis, and configured to rotate between an UNLOCKED position and a LOCKED position, wherein, when the cam rotates from the UNLOCKED position toward the LOCKED position, the cam rotates into the central lumen, and wherein the cam has a channel, and wherein the handguard further comprises a coupling member coupled to the body and configured to extend into the channel in order to maintain the cam on the body.

2. The handguard according to claim 1, wherein the handguard further comprises a barrel nut configured to be disposed in the central lumen and to engage the cam, and wherein, when the cam rotates from the UNLOCKED position toward the LOCKED position, the cam rotates into engagement with the barrel nut in a press fit manner in order to secure the barrel nut within the body.

3. The handguard according to claim 2, wherein the barrel nut comprises a body having a radial flute, and wherein, when the cam is in the LOCKED position, the cam engages the radial flute.

4. The handguard according to claim 2, wherein the cam is a first cam, wherein the handguard further comprises a second cam configured to rotate between UNLOCKED and LOCKED positions to secure the barrel nut within the body.

5. The handguard according to claim 2, wherein, when the cam rotates from the UNLOCKED position to the LOCKED position, the cam rotates between 110 degrees and 130 degrees.

6. The handguard according to claim 2, wherein the cam comprises a recessed surface, wherein, when the cam is in the UNLOCKED position, the recessed surface faces the central lumen, and wherein, when the cam is in the LOCKED position, the recessed surface faces away from the central lumen.

7. The handguard according to claim 6, wherein, when the cam rotates from the UNLOCKED position to the LOCKED position, the coupling member moves into engagement with an end portion of the channel, in order to prevent further rotation of the cam with respect to the body.

8. The handguard according to claim 2, wherein the coupling member is threadably coupled to the body.

9. The handguard according to claim 8, wherein the coupling member has a longitudinal axis substantially perpendicular to the longitudinal axis of the lumen.

10. A firearm, comprising:

an upper;

a barrel attached to the upper; and a handguard coupled to the barrel, the handguard comprising:

a body structured to be coupled to the firearm upper, the body having a central lumen having a longitudinal axis, and a cam coupled to the body in substantially perpendicular alignment to the longitudinal axis, and configured to rotate between an UNLOCKED position and a LOCKED position, wherein, when the cam rotates from the UNLOCKED position toward the LOCKED position, the cam rotates into the central lumen, and wherein the cam has a channel, and wherein the handguard further comprises a coupling member coupled to the body and configured to extend into the channel in order to maintain the cam on the body.

11. The firearm according to claim 10, wherein the handguard further comprises a barrel nut configured to be disposed in the central lumen and to engage the cam, and wherein, when the cam rotates from the UNLOCKED position toward the LOCKED position, the cam rotates into engagement with the barrel nut in a press fit manner in order to secure the barrel nut within the body.

12. The firearm according to claim 11, wherein the barrel nut comprises a body having a radial flute, and wherein, when the cam is in the LOCKED position, the cam engages the radial flute.

13. The firearm according to claim 11, wherein the cam is a first cam, wherein the handguard further comprises a second cam configured to rotate between UNLOCKED and LOCKED positions to secure the barrel nut within the body.

14. The firearm according to claim 11, wherein, when the cam rotates from the UNLOCKED position to the LOCKED position, the cam rotates between 110 degrees and 130 degrees.

15. The firearm according to claim 11, wherein the cam comprises a recessed surface, wherein, when the cam is in the UNLOCKED position, the recessed surface faces the central lumen, and wherein, when the cam is in the LOCKED position, the recessed surface faces away from the central lumen.

16. The firearm according to claim 15, wherein, when the cam rotates from the UNLOCKED position to the LOCKED position, the coupling member moves into engagement with an end portion of the channel, in order to prevent further rotation of the cam with respect to the body.

17. The firearm according to claim 11, wherein the coupling member is threadably coupled to the body.

18. The firearm according to claim 17, wherein the coupling member has a longitudinal axis substantially perpendicular to the longitudinal axis of the lumen.

* * * * *